US006848283B1

(12) United States Patent
Lin

(10) Patent No.: US 6,848,283 B1
(45) Date of Patent: Feb. 1, 2005

(54) COMBINATION LOCK CAPABLE OF BEING OPENED BY A KEY OR INHIBITED THE SAME

(76) Inventor: Chu Pao-Feng Lin, No. 4, dachang Rd., Ciaotou Township, Kaohsiung County (TW)

( * ) Notice: Subject to any disclaimer, the term of this patent is extended or adjusted under 35 U.S.C. 154(b) by 0 days.

(21) Appl. No.: 10/824,076

(22) Filed: Apr. 13, 2004

(51) Int. Cl.[7] ..... E05B 37/02

(52) U.S. Cl. ..... 70/21; 70/25; 70/38 A; 70/284; 70/285

(58) Field of Search ..... 70/21, 25, 26, 70/38 R, 38 A, 38 B, 284, 285, DIG. 9, DIG. 63, DIG. 71

(56) References Cited

U.S. PATENT DOCUMENTS

| | | | | | |
|---|---|---|---|---|---|
| 972,171 | A | * | 10/1910 | Dupont | 70/21 |
| 1,755,521 | A | * | 4/1930 | Smith | 70/21 |
| 4,751,830 | A | * | 6/1988 | Cheng | 70/25 |
| 5,715,709 | A | * | 2/1998 | Lai | 70/25 |
| 6,539,761 | B2 | * | 4/2003 | Yang | 70/284 |
| 6,708,534 | B1 | * | 3/2004 | Ruan | 70/38 A |
| 6,729,166 | B1 | * | 5/2004 | Lai | 70/25 |

* cited by examiner

*Primary Examiner*—Lloyd A. Gall
(74) *Attorney, Agent, or Firm*—Pro-Techtor International Services

(57) ABSTRACT

A combination lock capable of being opened by a key or inhibited the same is disclosed. In the locked position inserting a key into a lock core for turning an abutment member will open the lock. In the unlocked position press the trigger member for moving a post down until grooves clear from ridges, rotate the post a predetermined degree to matingly engage first and second toothed members together, release a trigger member to cause both itself and the post to move up, inclined bottom ends of ridges are gradually engaged with and finally stopped by a second ratchet member, the post is stopped from moving up, and a space between the post and a top hole of the abutment member is reduced sufficiently to inhibit a short leg from moving out of an upper bore by turning the key.

2 Claims, 10 Drawing Sheets

A~A'

COMBINATION LOCK CAPABLE OF BEING OPENED BY A KEY OR INHIBITED THE SAME

BACKGROUND OF THE INVENTION

1. Field of the Invention

The present invention relates to combination locks and more particularly to a combination lock which can be opened by an authorized person by means of a key in addition to the typical opening by arranging dials into a numeral sequence desired by the user. Further, the authorization can be inhibited.

2. Description of Related Art

Combination locks are well known. One particular type of combination lock is disclosed in U.S. Pat. No. 5,715,709. While the patent may be suitable for the particular purpose to which it addresses, it still has the drawbacks of being weak of certain components, possible loosening of sealing cap, and difficult of manufacturing due to excessive internal components. Moreover, it is known that a padlock can only be opened by a key. Unfortunately, an integral combination lock and padlock has not been disclosed as far as the present inventor is aware. Also, it is understood that a user may forget the combination of a combination lock if its correct numeral sequence has been changed for a number of times. For solving the problem, it is desirable to provide a novel combination lock which, in addition to the typical opening by arranging dials into a numeral sequence desired by a user, it can be opened by an authorized person by means of a key. Inhibition of the authorization is also desirable.

SUMMARY OF THE INVENTION

It is an object of the present invention to provide a combination lock comprising a substantially parallelepiped body; a U-shaped shackle having a long leg and a short leg; a plurality of parallel dials disposed at one side of the body with a lower portion of the long leg being releasably locked therein; a longitudinal bore disposed at the other side of the body, the longitudinal bore including an upper receiving hole, a lower cavity, an intermediate channel in communication with both the receiving hole and the cavity; and a key opening mechanism disposed in the longitudinal bore, the key opening mechanism comprising a first spring; a cylinder slidably provided in the receiving hole, the cylinder including an upper bore with a terminating end of the short leg being received therein in a locked position; a bottom shoulder with the first spring being put on, a lower bore in communication with the upper bore, a ring disposed between the upper and lower bores, a plurality of longitudinal ridges having an inclined bottom end, the ridges being provided on an inner wall of the lower bore and being equally spaced apart therearound, a first ratchet member formed on a lower portion of the shoulder, and two opposite tabs on an outer surface; a sleeve including two opposite recesses on an inner surface with the tabs received therein when the sleeve is put on the cylinder, the sleeve being urged upwardly by the first spring; a trigger member upwardly biased against a bottom of the ring, the trigger member including a plurality of equally spaced dents on an edge of its upper circular portion, the dents being slidably put on the ridges, and a lower first toothed member; a staged post provided in the lower bore and including a top second toothed member in contact with the first toothed member, and a plurality of equally spaced projections on an upper part of an outer surface so that a longitudinal groove is formed between two adjacent projections, and a second ratchet member formed on upper edges of the projections; a second spring having a top end urged against bottoms of the projections; a staged abutment member including a top hole with a lower portion of the post inserted thereinto, a top flat urged by a bottom end of the second spring, a third ratchet member formed on a projected intermediate portion, the third ratchet member being matingly shaped with respect to the first ratchet member, and a lower, hollow cylindrical member disposed in the channel; and a lock core provided in the cavity and including a top protuberance inserted into the hollow cylindrical member for fastening, wherein in an assembled position the third ratchet member is not matingly engaged with the first ratchet member so as to form a space between a bottom of the post and a bottom of the top hole of the abutment member; wherein in the locked position it is operable to insert a key into the lock core and turn the key to rotate the abutment member without a correct combination being formed by the dials, the cylinder is pushed down by an expansion of the first spring when the first and second ratchet members are matingly engaged, and the terminating end of the short leg is disengaged from the upper bore for unlocking the combination lock; and in the unlocked position it is operable to press the trigger member for moving the post down until the grooves clear from the ridges, rotate the post a predetermined degree to matingly engage the first and second toothed members together, release the trigger member to cause both itself and the post to move up, the inclined bottom ends of the ridges are gradually engaged with and finally stopped by the second ratchet member, the post is stopped from continuously moving up, and the space is reduced a predetermined extent to inhibit the terminating end of the short leg from moving out of the upper bore by turning the key.

The above and other objects, features and advantages of the present invention will become apparent from the following detailed description taken with the accompanying drawings.

DETAILED DESCRIPTION OF THE PREFERRED EMBODIMENTS

Figure 1:
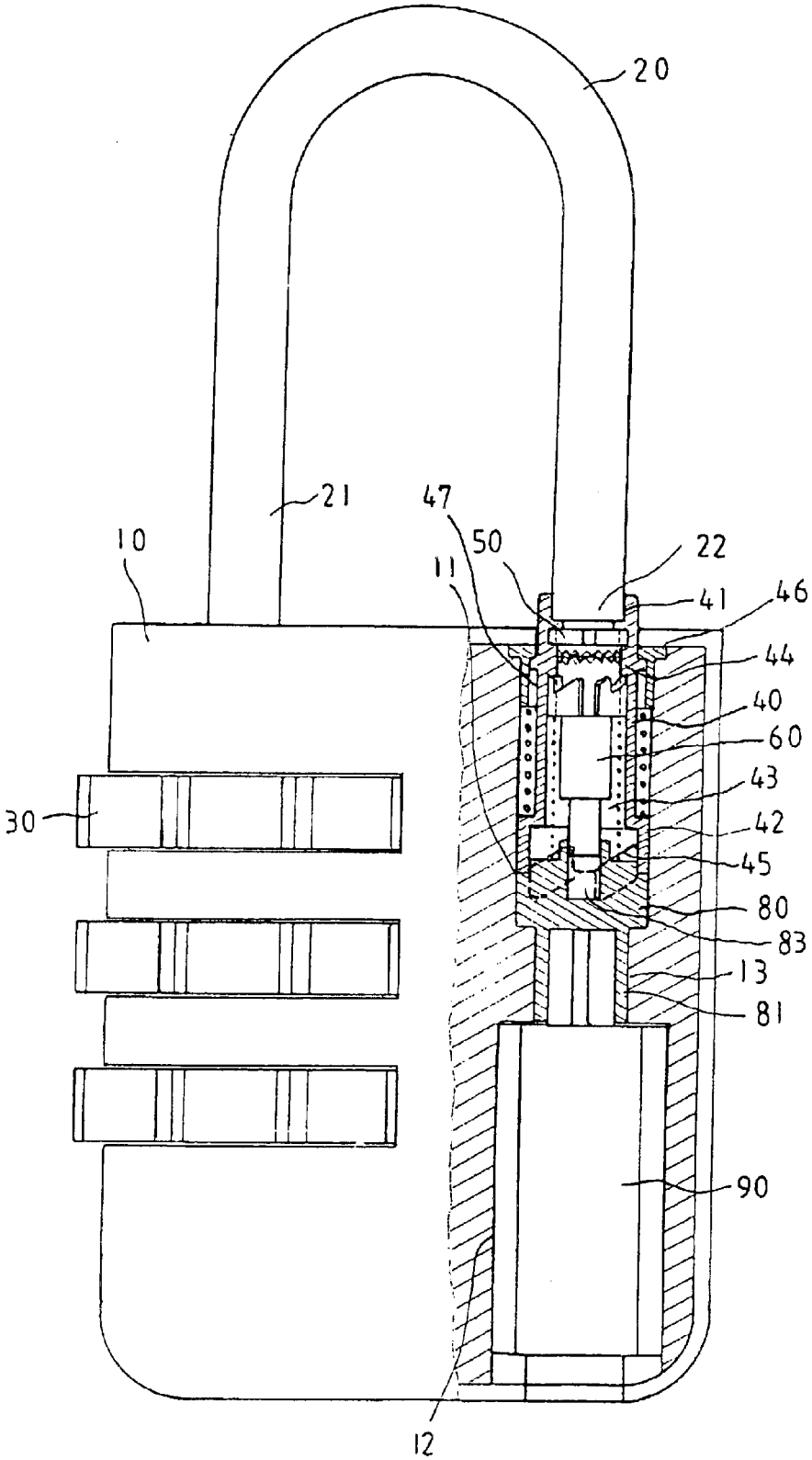
FIG. 1 is a side view in part section of a combination lock according to the invention.
Figure 2:
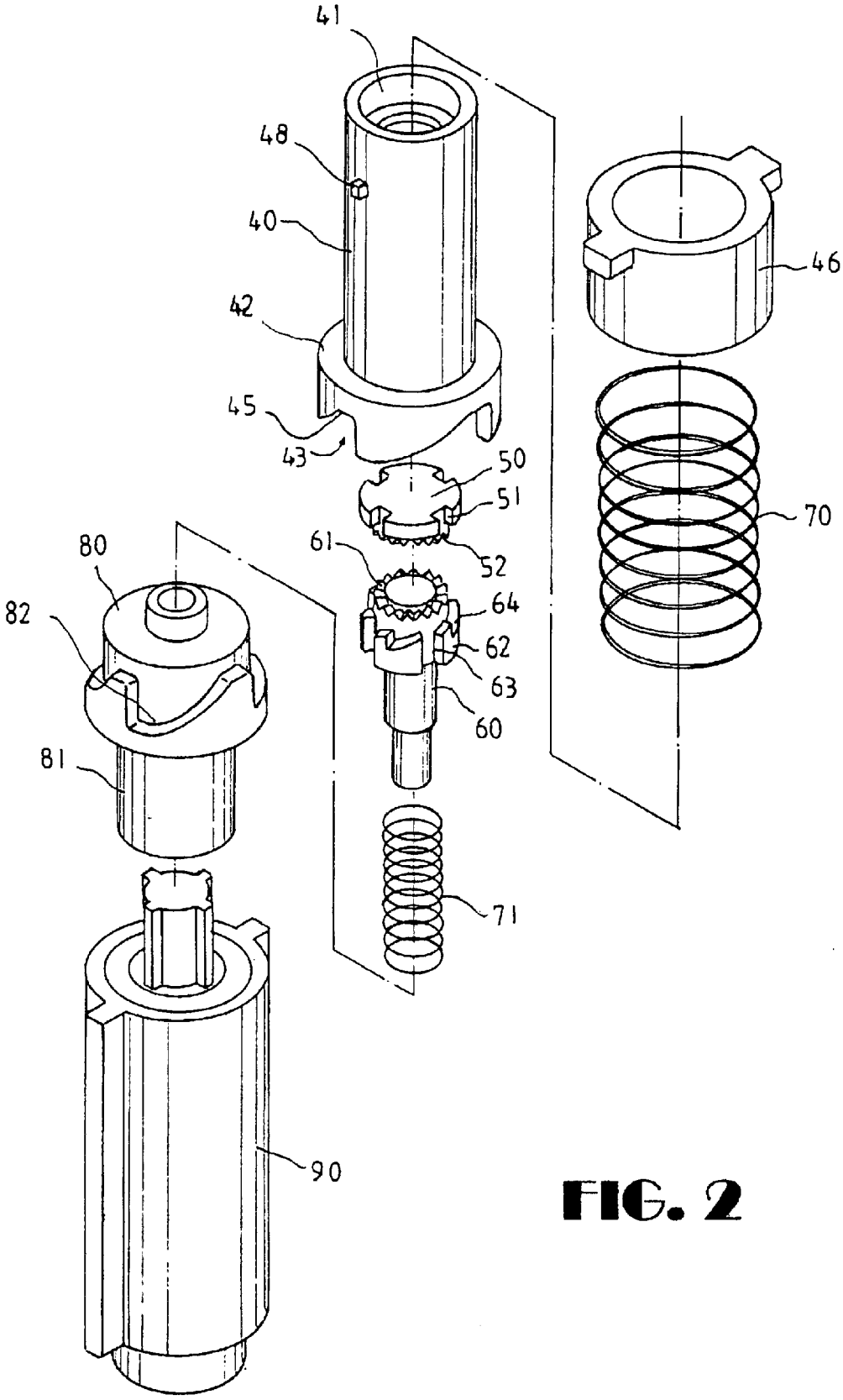
FIG. 2 is an exploded view of the components shown in the sectional portion of FIG. 1, i.e., key opening mechanism.
Figure 3:
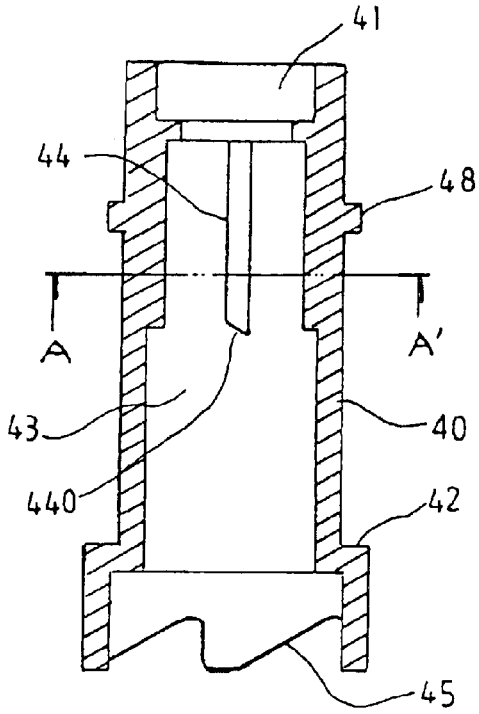
FIG. 3 is a sectional view of cylinder.
Figure 4:
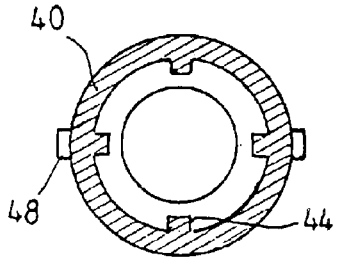
FIG. 4 is a sectional view taken along line A—A of FIG. 3.

Referring to FIGS. 1 to 12, a combination lock constructed in accordance with the invention is shown. The combination lock comprises a substantially parallelepiped body 10, a U-shaped shackle 20 having a long leg 21 and a short leg 22, a plurality of parallel dials 30 at one side of the body 10 with a lower portion of the long leg 21 being releasably locked therein, and a key opening mechanism provided in a longitudinal bore at the other side of the body 10 (i.e., one shown in the sectional portion of FIG. 1), the longitudinal bore comprising an upper receiving hole 11, a lower cavity 12, an intermediate channel 13 in communication with both the receiving hole 11 and the cavity 12. A terminating end of the short leg 22 is also releasably locked in a top of the key opening mechanism (e.g., the receiving hole 11). The components of the key opening mechanism and its assembly and operations will be described in detail below.

A cylinder 40 is slidably provided in the receiving hole 11. The cylinder 40 comprises an upper bore 41, a bottom shoulder 42 so that a first spring 70 put on the cylinder 40 is able to always press down the shoulder 42, a lower bore 43 in communication with the upper bore 41, four longitudinal ridges 44 having a slanted surface 440 at its bottom end, the ridges 44 being provided on an inner wall of the lower bore 43 and being equally spaced apart therearound, a ratchet member 45 formed on a lower portion of the shoulder 42, and two opposite tabs 48 on an outer surface of the cylinder 40. A trigger member 50 is upwardly biased against bottom of an internal ring between the bores 41 and 43. The trigger member 50 comprises four equally spaced dents 51 on an edge of its upper circular portion and a toothed member 52 around a bottom of its lower short cylindrical portion. The dents 51 are slidably put on the ridges 44 so that the trigger member 50 is only permitted to move longitudinally.

A staged post 60 is provided in the lower bore 43 and comprises a top toothed member 61 in contact with the toothed member 52 of the trigger member 50, and a plurality of equally spaced projections 62 on an upper part of the outer surface so that a longitudinal groove 63 is formed between two adjacent projections 62, the groove 63 being aligned with the dent 51 with the ridge 44 slidably passed through, and a ratchet member 64 is formed on upper edges of the projections 62. A second spring 71 smaller than the first spring 70 has a top end urged against bottoms of the projections 62.

A staged abutment member 80 comprises a top flat urged by a bottom end of the second spring 71, a ratchet member 82 formed on a projected intermediate portion, the ratchet member 82 being matingly shaped with respect to the ratchet member 45, and a lower, hollow cylindrical member 81 disposed in the channel 13. A lock core 90 is provided in the cavity 12 and comprises a top protuberance inserted into the hollow cylindrical member 81 for fastening. In an assembled state, the ratchet member 82 is not matingly engaged with the ratchet member 45. As such, a space 83 is formed between a bottom of the post 60 and a bottom of a top hole of the abutment member 80.

Figure 5:
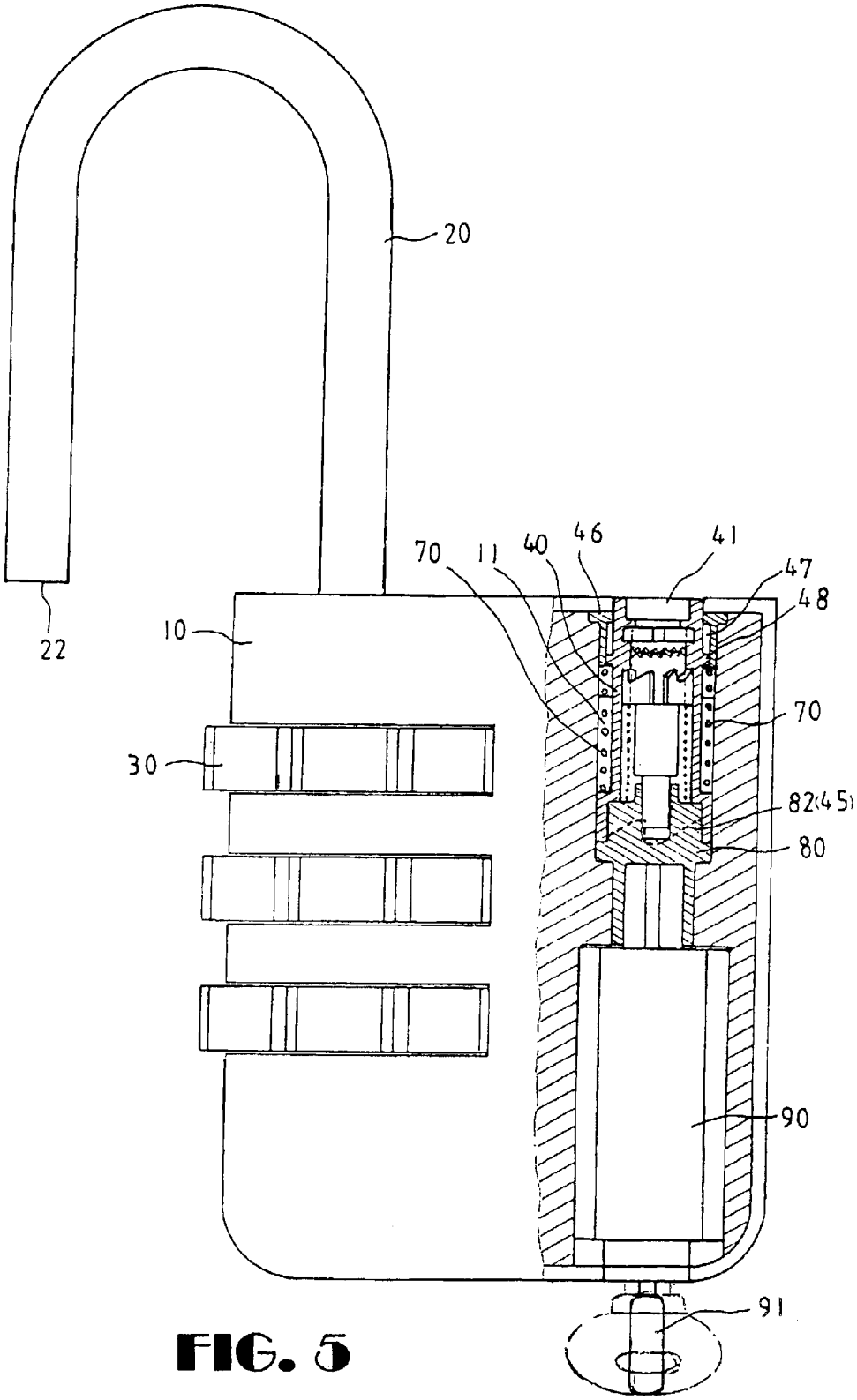
FIG. 5 is a view similar to FIG. 1, where a key has been inserted into a lock core to open the lock with shackle pivoted about 180 degrees from its locked position.
Figure 6:
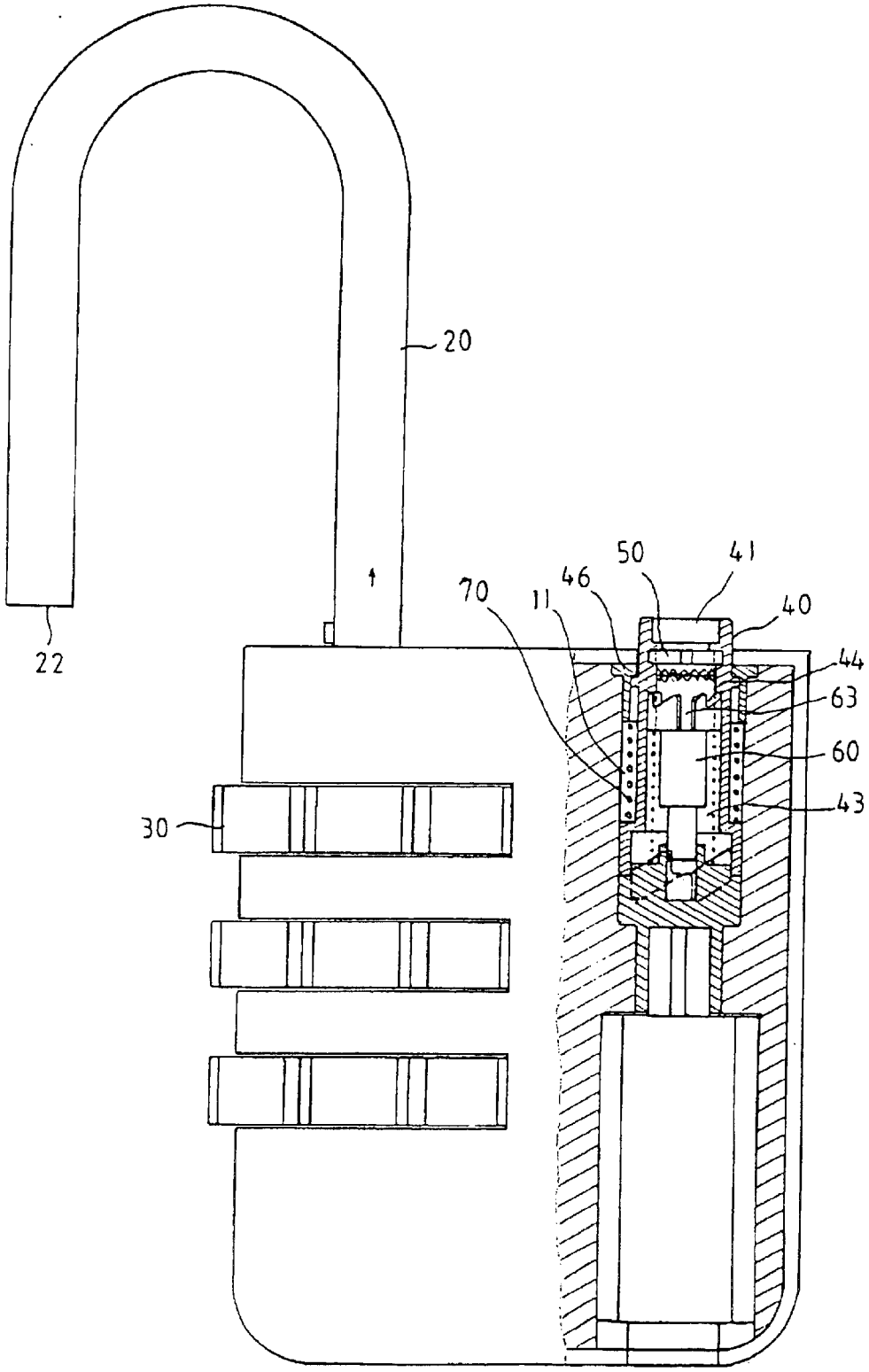
FIG. 6 is a view similar to FIG. 1, where the key is removed and a long leg of the shackle is pulled up in the unlocked position as a result of correct combination of the dials.
Figure 7:
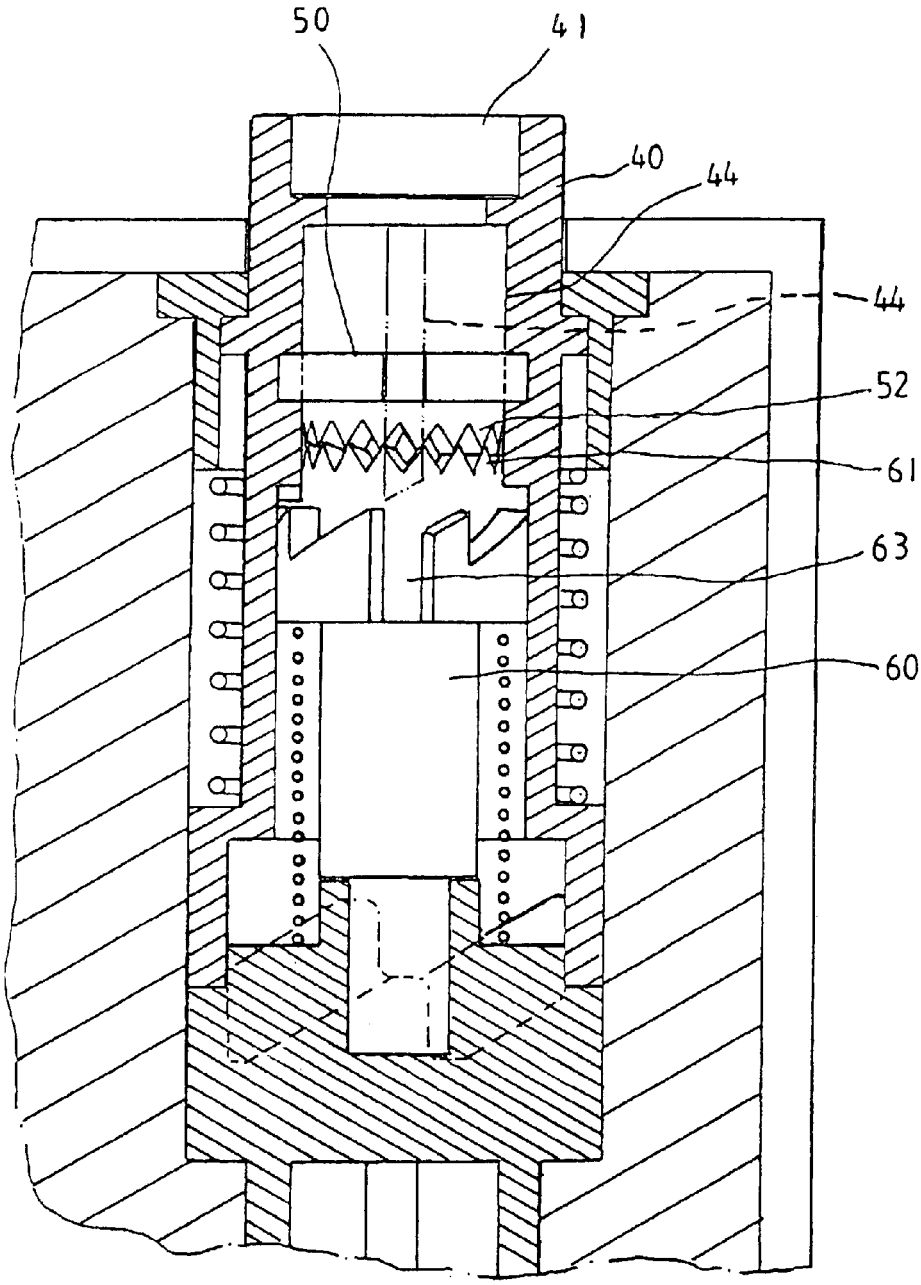
FIG. 7 is an enlarged view of the upper part shown in the sectional portion of FIG. 6.
Figure 8:
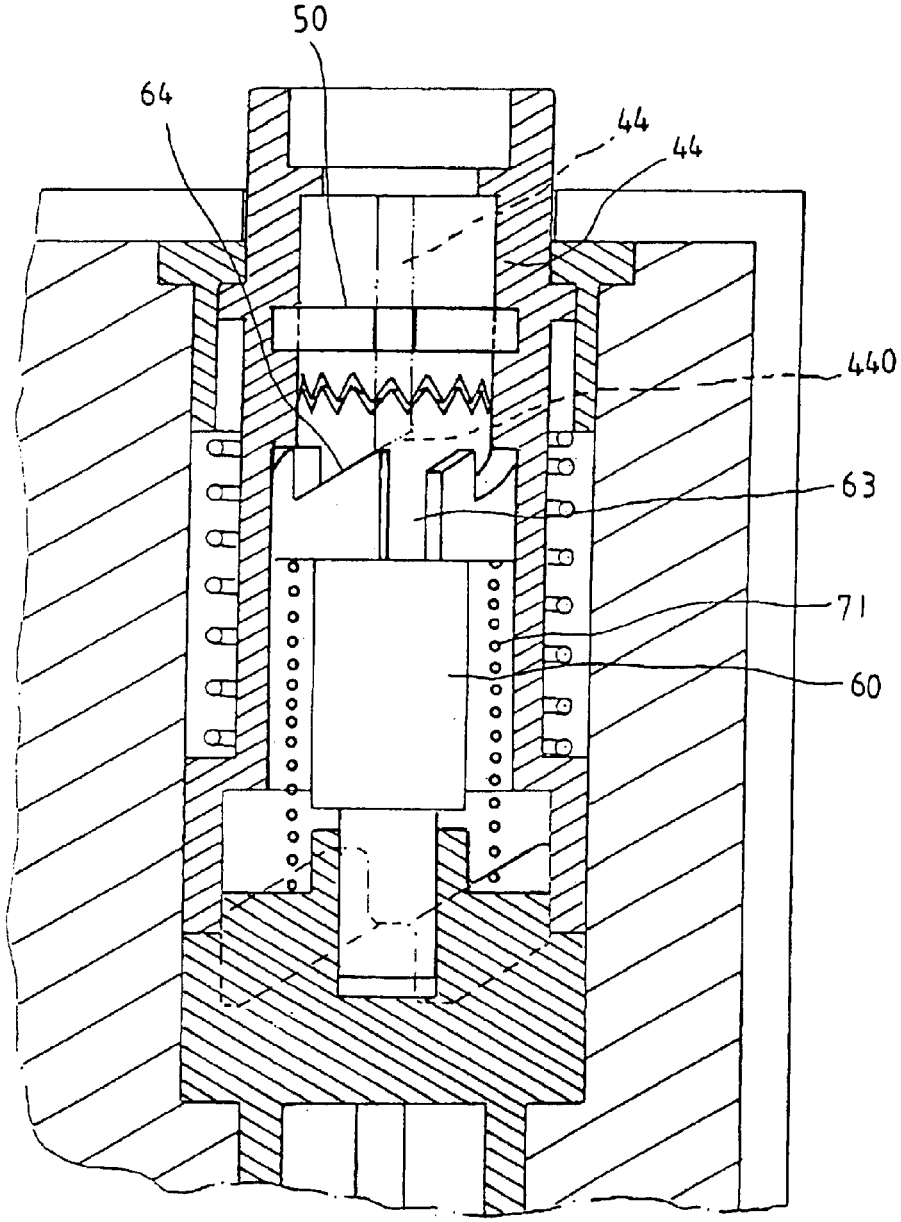
FIGS. 8 and 9 are views similar to FIG. 7 for illustrating subsequent operations of disabling the key opening mechanism.
Figure 9:
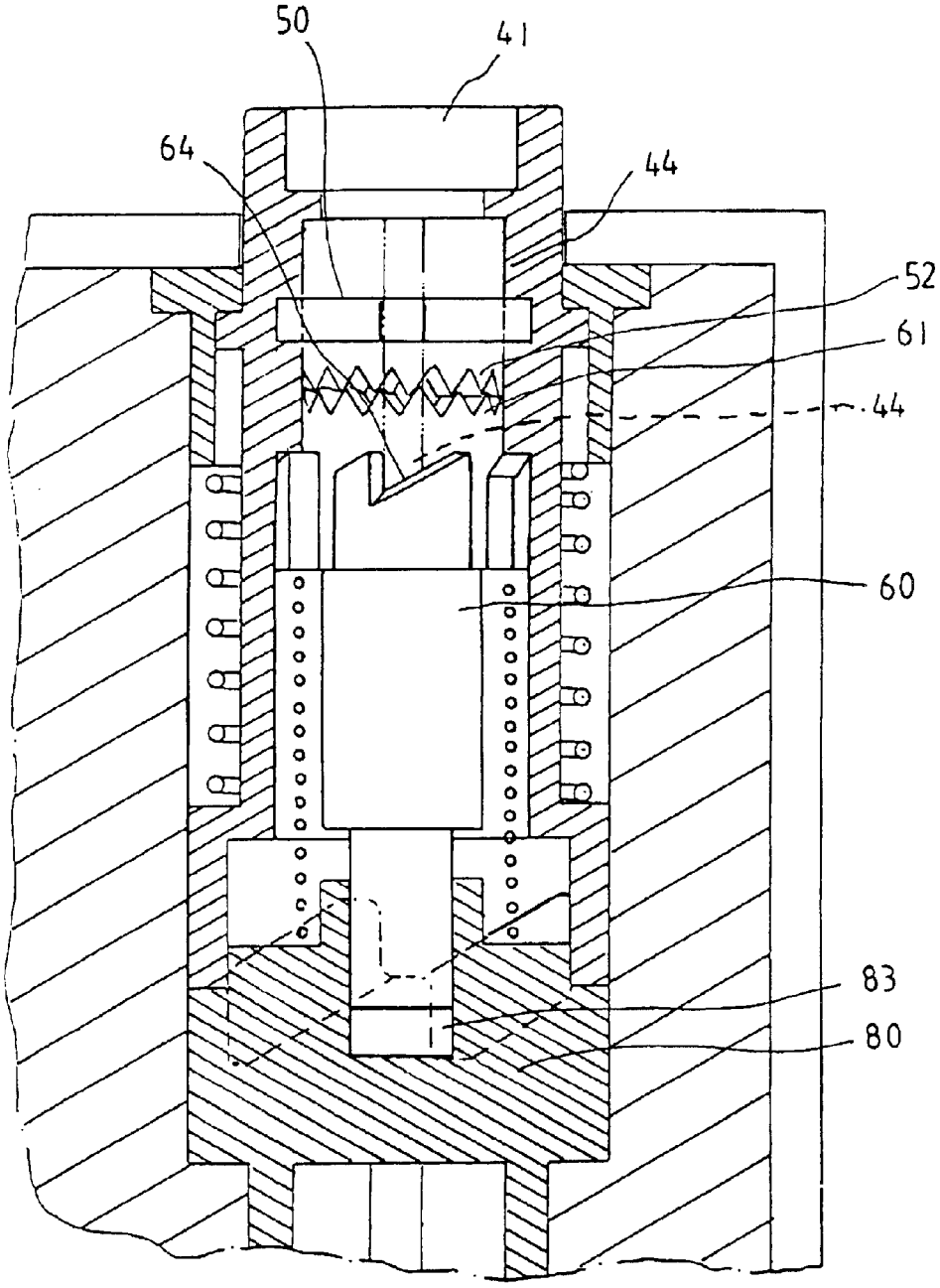
Figure 10:
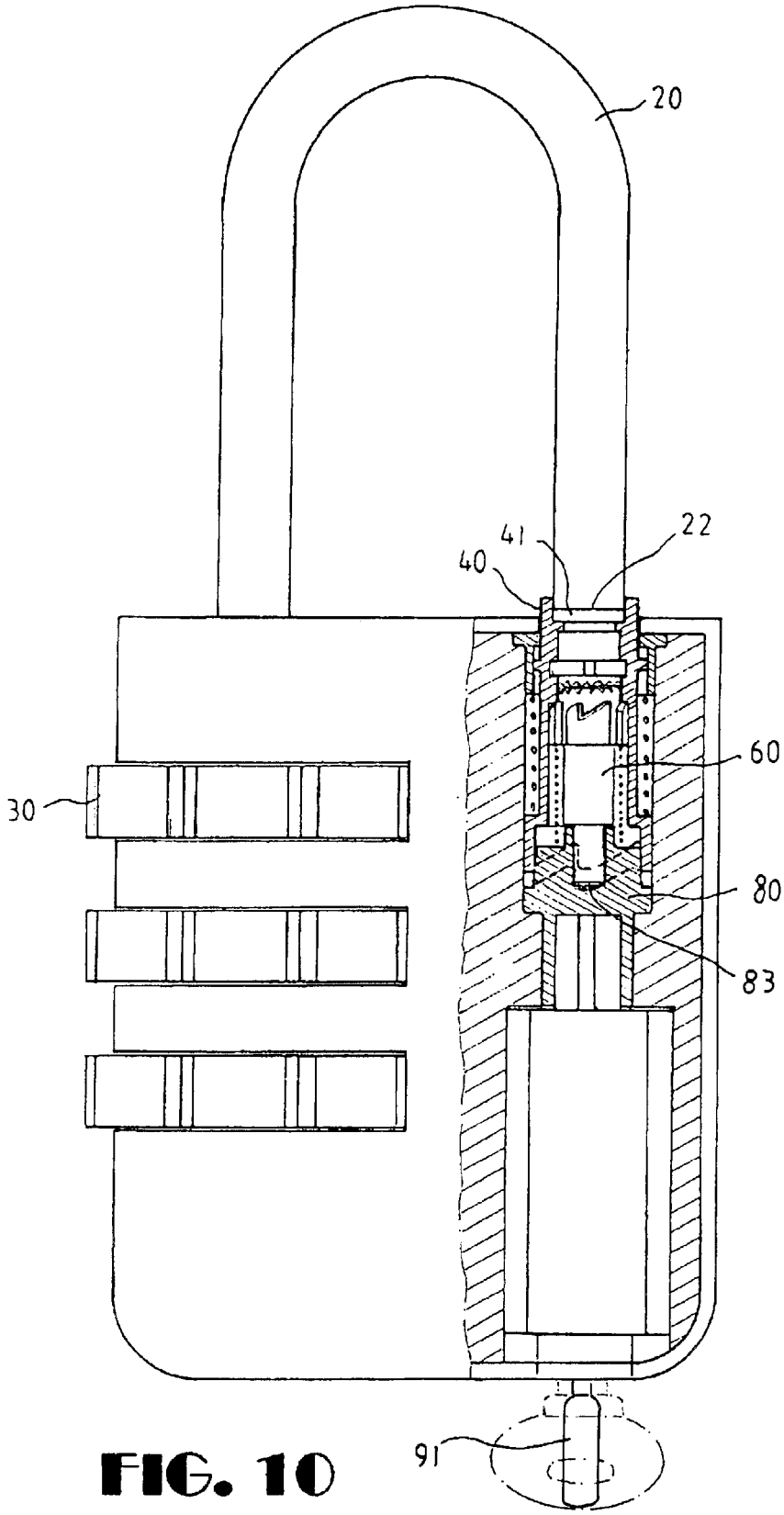
FIG. 10 is a view similar to FIG. 1, where the key opening mechanism is disabled such that a turning of the inserted key will not open the lock.
Figure 11:
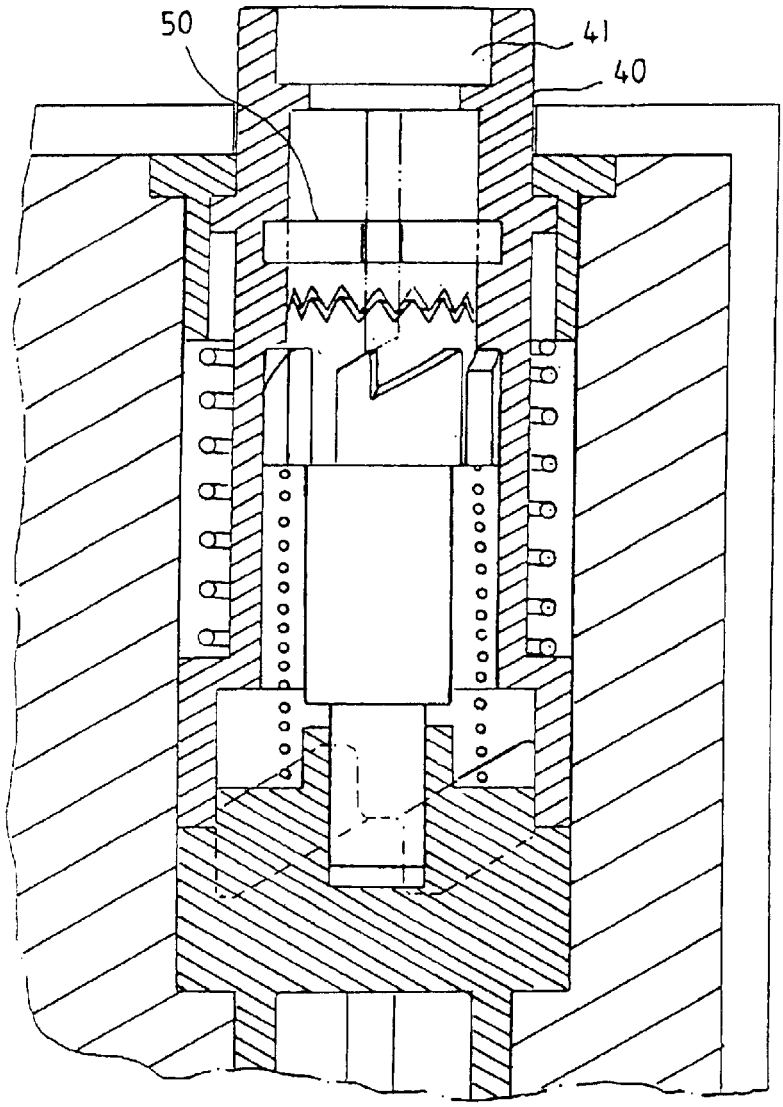
FIG. 11 is a view similar to FIG. 7 for illustrating an operation of enabling the key opening mechanism again.
Figure 12:
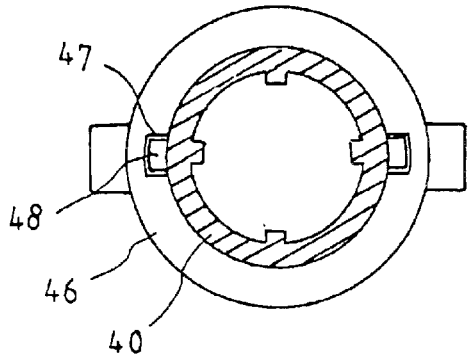
FIG. 12 is a top view in part section of the coupled cylinder and sleeve for illustrating a permission of vertical movement and an inhibition of rotational movement of the cylinder.

In a case of the terminating end of the short leg 22 received in the upper bore 41 (i.e., locked), it is possible of inserting a key 91 into the lock core 90 and then turning the key 91 to rotate the abutment member 80 without a correct combination being formed by the dials 30 (see FIG. 5). The cylinder 40 is then pushed downwardly further into the body 10 by the expansion of the first spring 70 when the ratchet members 82 and 45 are matingly engaged. As a result, the terminating end of the short leg 22 is disengaged from the upper bore 41 (i.e., unlocked). As shown in FIG. 6, a correct combination of the dials 30 can unlock the combination lock. Next, pull the terminating end of the short leg 22 out of the upper bore 41. Next, use a pointed object to insert into the upper bore 41 for pressing the trigger member 50. The trigger member 50 then moves to cause the post 60 to move down until the grooves 63 clear from the ridges 44 (see FIG. 7). At this time, slightly rotating the post 60 will matingly engage the toothed member 52 with the toothed member 61 (see FIG. 8). Next, release the trigger member 50 will cause itself and the post 60 to move up. As such, the slanted surfaces 440 of the ridges 44 are gradually engaged with and finally stopped by the valleys of the ratchet member 64 (see FIG. 9). This also stops the post 60 from continuously moving up in the upper bore 41. Further, the space 83 is reduced (see FIG. 10). In a case of the terminating end of the short leg 22 received in the upper bore 41 again (i.e., locked), it is possible of inserting a key 91 into the lock core 90 and then turning the key 91 to rotate the abutment member 80. However, it is impossible of clearing the terminating end of the short leg 22 from the upper bore 41 since the reduced space 83 inhibits a sufficient downward movement of the cylinder 40 from occurring. That is, the combination lock is still locked. In this case only a correct combination formed by the dials 30 can open the lock (i.e., the terminating end of the short leg 22 can be removed from the upper bore 41) as shown in FIG. 11. A pressing of the trigger member 50 by a pointed object will cause the key opening mechanism to return to a state as shown in FIG. 1. At this position, a user can use a key to open the lock.

A sleeve 46 is put on the cylinder 40 in which the tabs 48 are received in two opposite recesses 47 on an inner surface of the sleeve 46 so as to support the sleeve 46. A reverse rotation of the abutment member 80 by turning the lock core 90 by a key 91 is prevented due to the engagement of the ratchet members 82 and 45. Further, a rotation of the cylinder 40 is inhibited due to the engagement of the tabs 48 and the recesses 47. In other words, the cylinder 40 is only permitted to move longitudinally.

While the invention herein disclosed has been described by means of specific embodiments, numerous modifications and variations could be made thereto by those skilled in the art without departing from the scope and spirit of the invention set forth in the claims.

What is claimed is:

1. A combination lock comprising:

a substantially parallelepiped body;

a U-shaped shackle having a long leg and a short leg;

a plurality of parallel dials disposed at one side of the body with a lower portion of the long leg being releasably locked therein;

a longitudinal bore disposed at the other side of the body, the longitudinal bore including an upper receiving hole, a lower cavity, an intermediate channel in communication with both the receiving hole and the cavity; and a key opening mechanism disposed in the longitudinal bore, the key opening mechanism comprising:

a first spring;

a cylinder slidably provided in the receiving hole, the cylinder including an upper bore with a terminating end of the short leg being received therein in a locked position, a bottom shoulder with the first spring being put on, a lower bore in communication with the upper bore, a ring disposed between the upper and lower bores, a plurality of longitudinal ridges having an inclined bottom end, the ridges being provided on an inner wall of the lower bore and being equally spaced apart therearound, a first ratchet member formed on a lower portion of the shoulder, and two opposite tabs on an outer surface;

a sleeve including two opposite recesses on an inner surface with the tabs received therein when the sleeve is put on the cylinder, the sleeve being urged upwardly by the first spring;

a trigger member upwardly biased against a bottom of the ring, the trigger member including a plurality of equally spaced dents on an edge of its upper circular portion, the dents being slidably put on the ridges, and a lower first toothed member;

a staged post provided in the lower bore and including a top second toothed member in contact with the first toothed member, and a plurality of equally spaced projections on an upper part of an outer surface so that a longitudinal groove is formed between two adjacent projections, and a second ratchet member formed on upper edges of the projections;

a second spring having a top end urged against bottoms of the projections;

a staged abutment member including a top hole with a lower portion of the post inserted thereinto, a top flat urged by a bottom end of the second spring, a third ratchet member formed on a projected intermediate portion, the third ratchet member being matingly shaped with respect to the first ratchet member, and a lower, hollow cylindrical member disposed in the channel; and a lock core provided in the cavity and including a top protuberance inserted into the hollow cylindrical member for fastening, wherein in an assembled position the third ratchet member is not matingly engaged with the first ratchet member so as to form a space between a bottom of the post and a bottom of the top hole of the abutment member;

wherein in the locked position it is operable to insert a key into the lock core and turn the key to rotate the abutment member without a correct combination being formed by the dials, the cylinder is pushed down by an expansion of the first spring when the first and third ratchet members are matingly engaged, and the terminating end of the short leg is disengaged from the upper bore for unlocking the combination lock; and in the unlocked position it is operable to press the trigger member for moving the post down until the grooves clear from the ridges, rotate the post a predetermined degree to matingly engage the first and second toothed members together, release the trigger member to cause both itself and the post to move up, the inclined bottom ends of the ridges are gradually engaged with and finally stopped by the second ratchet member, the post is stopped from moving up, and the space is reduced a predetermined extent to inhibit the terminating end of the short leg from moving out of the upper bore by turning the key.

2. The combination lock of claim 1, wherein the number of each of the ridges, the grooves, and the dents is four.

* * * * *